US006306228B1

(12) United States Patent
Inoue et al.

(10) Patent No.: US 6,306,228 B1
(45) Date of Patent: Oct. 23, 2001

(54) METHOD OF PRODUCING AMORPHOUS ALLOY EXCELLENT IN FLEXURAL STRENGTH AND IMPACT STRENGTH

(75) Inventors: Akihisa Inoue; Tao Zhang; Nobuyuki Nishiyama, all of Sendai (JP)

(73) Assignee: Japan Science and Technology Corporation, Kawaguchi (JP)

( * ) Notice: Subject to any disclaimer, the term of this patent is extended or adjusted under 35 U.S.C. 154(b) by 0 days.

(21) Appl. No.: 09/486,953

(22) PCT Filed: Jun. 24, 1999

(86) PCT No.: PCT/JP99/03386

§ 371 Date: Mar. 6, 2000

§ 102(e) Date: Mar. 6, 2000

(87) PCT Pub. No.: WO00/02687

PCT Pub. Date: Jan. 20, 2000

(30) Foreign Application Priority Data

Jul. 8, 1998 (JP) ..... 10-210415

(51) Int. Cl.[7] ..... B22D 18/00; C22C 45/00
(52) U.S. Cl. ..... 148/538; 148/561; 164/113
(58) Field of Search ..... 148/538, 561; 164/113

(56) References Cited

U.S. PATENT DOCUMENTS 5,324,368 * 6/1994 Masumoto et al. ..... 148/561
5,711,363 * 1/1998 Scruggs et al. ..... 164/113

FOREIGN PATENT DOCUMENTS 3-204160 9/1991 (JP) .
5-253656 10/1993 (JP) .
10-296424 11/1998 (JP) .

OTHER PUBLICATIONS

"Fabrication of Bulky Zr–Based Glassy Alloys by Suction Casting into Copper Mold" by Akihisa Inoue et al., Materials Transaction, Japan Institute of Metals (English Version) issued on 1995, vol. 36, No. 9, pp. 1184 to 1187 (see spec. p. 2).
"Preparation and Thermal Stability of Bulk Amorphous $Pd_{40}Cu_{30}Ni_{10}P_{20}$ Alloy Cylinder of 72 mm in Diameter" by Akihisa Inoue et al., Materials Transactions, Japan Institute of Metals (English Version) issued on 1997, vol. 38, No. 2, pp. 179 to 183 (see spec. p. 2).

* cited by examiner

*Primary Examiner*—George Wyszomierski
(74) *Attorney, Agent, or Firm*—Armstrong, Westerman, Hattori, McLeland & Naughton, LLP

(57) ABSTRACT

A molten alloy was pressure-solidified under a pressure exceeding one atmospheric pressure to eliminate casting defects. The molten alloy was solidified by applying a cooling rate difference to the surface and the interior of the molten alloy to allow a compressive stress layer to remain on the surface of the amorphous alloy ingot and a tensile stress layer in the interior portion. Thus, a amorphous alloy sheet having a thickness of 1 mm or more and excellent in bending strength and impact strength is obtained.

2 Claims, No Drawings

METHOD OF PRODUCING AMORPHOUS ALLOY EXCELLENT IN FLEXURAL STRENGTH AND IMPACT STRENGTH

FIELD OF THE INVENTION

This invention relates to a method for producing an amorphous alloy having characteristics excellent in flexural strength (bending strength) and impact strength.

TECHNICAL BACKGROUND

It has been well known that amorphous metallic materials having various shapes, such as a thin strip shape, a filament shape and a powder particle shape, can be obtained by quickly cooling a molten alloy. Since an amorphous alloy thin strip can be easily manufactured by a method which can obtain a large cooling rate, such as a single-roll method, a dual-roll method, a rotating liquid spinning method, or the like, a number of amorphous Fe-alloy, Ni-alloy, Co-alloy, Pd-alloy, Cu-alloy, Zr-alloy and Ti-alloy have been successively obtained. Since these amorphous alloys have industrially very important characteristics such as high corrosion resistance, high strength and the like, which cannot be obtained by crystalline metallic materials, an application of these amorphous alloys in the fields of new structural materials, medical-use materials, chemical materials, or the like, has been expected.

However, according to the aforementioned manufacturing methods, amorphous alloys can only be obtained as a thin strip or a thin wire. Thus, it was difficult to form such amorphous alloys into a final product shape, resulting in an industrially limited usage.

Various studies regarding an improvement of a manufacturing efficiency of an amorphous alloy, an optimization of a composition and a manufacturing method have recently been conducted, and an amorphous alloy ingot having a size which meets the requirements of structural materials has been manufactured. For example, as a Zr—Al—Cu—Ni alloy, an amorphous alloy ingot having a diameter of 30 mm and a length of 50 mm has been successfully obtained (see "Materials Transactions, Japan Institute of Metals" (English version) issued on 1995, Vol. 36, Item. No. 1184). As a Pd—Ni—Cu—P alloy, an amorphous alloy ingot having a diameter of 72 mm and a length of 75 mm has been successfully obtained (see "Materials Transactions, Japan Institute Metals" (English version) issued on 1997, Vol. 38, Item. No. 179). These amorphous alloy ingots have a tensile strength of 1700 MPa or more and a Vickers hardness of 500 or more, and are expected to be used as unique high-strength structural materials having extremely high elastic limit.

DISCLOSURE OF THE INVENTION

(OBJECTS TO BE SOLVED BY THE INVENTION)

However, since the aforementioned amorphous alloy ingots are poor in plastic workability at room temperature due to the irregular atomic structure (glass-like structure), the dynamic strength thereof against a bending load, an impact load, and the like, tends to be insufficient, resulting in poor reliability as practical structural materials. Under such circumstances, it has been desired that an amorphous alloy which has improved dynamic strength against a bending load and an impact load without causing a deterioration of high strength high elastic limit characteristics due to the amorphous structure as well as its manufacturing method, is developed.

(MEANS FOR SOLVING THE PROBLEMS)

To solve the above mentioned problems, the present inventors have eagerly studied for the purpose of providing a practically endurable amorphous alloy having an enhanced bending strength and impact strength combined with high strength characteristics due to the amorphous structure. As a result, the inventors have found the fact that the bending strength and the impact strength can be enhanced by eliminating casting defects by pressure-solidifying molten alloy under a pressure exceeding one atmospheric pressure and solidifying it by applying a cooling rate difference with a cooling medium having an appropriate heat capacity between the surface and the interior of the molten alloy so that a compressive stress layer remains on the surface of the amorphous alloy ingot and a tensile stress layer remains in the interior thereof. By optimizing the manufacturing conditions which can effectively realize the strengthening mechanism, the present invention has been completed.

The present invention is to provide an amorphous alloy excellent in bending strength and impact strength by avoiding a stress concentration near casting detects to maintain an inner stress in the alloy.

(THE BEST MODE FOR CARRYING OUT THE INVENTION)

A preferred embodiment of the present invention will now be described as follows.

In general, a cooling rate required to form an amorphous alloy differs depending on an alloy to be manufactured because an amorphous alloy forming ability differs depending on an amorphous alloy to be manufactured. Therefore, the present invention adapts a manufacturing method including the steps of: solidifying a molten alloy at a cooling rate approximately 50% larger than a cooling rate at which the whole molten alloy forms an amorphous alloy (critical cooling rate) to quickly cool the surface of the alloy; and then cooling the alloy in a metal mold heated by a heat transmission and solidifying the inside of the alloy at nearly around the critical cooling rate to form an amorphous alloy, whereby a compression stress layer remains at the surface of the amorphous alloy and a tensile stress layer remains at the interior thereof.

Furthermore, the present invention can be preferably carried out by optimizing the manufacturing conditions which realizes the strengthening mechanism, that is to say, by making the interior of the molten alloy into an amorphous alloy at around the critical cooling rate by heating it by the transmitted heat while quickly cooling the surface of the desired molten alloy with a cooling medium having an optimum heat capacity, and by effectively generating the cooling rate difference between the surface and the interior of the amorphous alloy due to the thickness of the amorphous alloy. Therefore, it is preferable to use a manufacturing device which can control the cooling rate to a desired level in accordance with the amorphous forming ability of the amorphous alloy to be manufactured. The cooling rate adjustment can be preferably performed by, for example, adjusting the heat capacity of the mold, adjusting the amount of the mold cooling water, optimizing the minimum thickness of the alloy, or controlling the temperature of the molten alloy when the molten alloy is being cast.

Furthermore, in order to effectively eliminate casting defects which may cause a start point of fracture of an amorphous alloy according to the present invention, it is preferable that a pressure to be applied at the time of casting is controllable. In a pressure-casting apparatus, the effective applied pressure is a pressure exceeding one atmospheric pressure. More preferably, the applied pressure is a pressure exceeding two atmospheric pressure. If the applied pressure is not larger than one atmospheric pressure, it is impossible to eliminate the casting defects generated at the time of casting. The applied pressure can be preferably obtained by a die compression method which utilizes an oil-pressure, an air-pressure, an electric-driving, or the like, and an injection casting method such as a die casting or a squeeze casting.

In an amorphous alloy sheet according the present invention, the minimum thickness is set to be 1 mm or more. The minimum thickness coincides with a direction vertical to a heat flow rate caused by a cooling, and generally means the sheet thickness. The above regulation is a necessary and essential condition for manufacturing an amorphous alloy having an inner residual stress which constitutes the basis of the present invention. That means that, if the minimum thickness is less than 1 mm, although an alloy having an amorphous structure can be easily obtained, in actual, a cooling difference cannot be effectively generated between the surface of the molten alloy and the interior thereof, which fails to improve the bending strength and impact strength. On the other hand, if the minimum thickness is 10 mm or more, in currently available amorphous forming alloys, a complete amorphous structure cannot be obtained, and some of them may precipitate large metallic compounds. These large compounds not only hinder an improvement of the dynamic strength of the alloy because they function as a start point of fracture, but also cause a deterioration of the high strength and the high elastic limit characteristics inherent in an amorphous alloy.

Therefore, it is preferable that the thickness of the amorphous alloy sheet to be manufactured by the manufacturing method according to the present invention is 1 mm or more. From a view point of a mechanical strength, it is preferable that the thickness is 10 mm or less.

The following is an explanation of the reasons why the bending strength and the impact strength of the amorphous alloy are improved by the existence of the surface residual compressive stress and the interior residual tensile stress.

In a normal metal crystal, it has an easy-to-deform axis which is partially deformed easily because of its regular atomic arrangement. The strength of a crystalline metallic material is defined by the aforementioned easy-to-deform axis. However, an amorphous alloy has structural characteristics that the atomic arrangement is isotropic and disordered. Due to the structural characteristics, the amorphous alloy does not have anisotropy which is easily deformed plastically in partial. Therefore, an amorphous alloy shows high strength and high elastic limit characteristics because the alloy has no axis partially low in strength. However, having no plastically easy-to-bend axis causes a deterioration of the bending strength and the impact strength.

By applying the pressure defined by the manufacturing method according to the present invention, casting defects existing in an amorphous alloy sheet can be eliminated effectively. When an external stress is applied, various stress concentrations will occur at around casting defects depending on their configurations, resulting in a deterioration of the statical strength and dynamic strength of the amorphous alloy. Therefore, an elimination of casting defects is very effective to improve a strength of an amorphous alloy. Furthermore, to maintain compressive stress on the surface of the amorphous alloy and tensile stress in the interior thereof, as disclosed by the present invention, gives an effect similar to a wind strengthening effect which is usually employed in oxide glass.

Residual compressive stress of a surface of an amorphous alloy sheet to be manufactured by the manufacturing method according to the present invention was estimated. The compressive stress ($\sigma$) acting on the surface can be calculated by the following equation (1) by using the maximum thermal difference ($\Delta$Tmax) between the surface temperature of the amorphous alloy sheet and the internal temperature thereof at the time of cooling, the Young's modulus (E) of glass and the thermal expansion coefficient ($\alpha$).

$$\sigma=[\alpha E/(1-\mu)]2\Delta Tmax/3 \quad (1)$$

The compressive stress which generates on the surface at the temperature difference of 800K is estimated to be approximately 1740 Mpa from the following data, i.e., $\alpha=21\times10^{-6}$ and E=90 GPa which are actual measured data obtained through experiments, $\mu$=0.42 disclosed in the reference (H. S. Chen, J. Appl. Phys., published in 1978, vol. 49, p462) and $\Delta$Tmax=800K. This estimated value generally corresponds to an increased amount of bending strength of the amorphous alloy due to the residual stress. Therefore, an amorphous alloy manufactured by the manufacturing method according to the present invention includes a large amount of interior residual stress, and it is surmised that the interior residual stress improves the strength against bending loads and impact loads.

An amorphous alloy sheet excellent in tensile strength, bending strength and impact strength according to the present invention, can be easily obtained by applying the aforementioned preferable manufacturing method to a molten alloy heated by, for example, an arc discharging method or a high frequency induction heating method.

EXAMPLE

Examples of the present invention will be explained as follows. Starting from the materials whose alloy compositions are shown in Table 1 (Example Nos. 1 to 5), amorphous alloy sheets each having a thickness of 3 mm were manufactured by a pressure casting machine capable of a mold compression by air pressure on the conditions of 3 atmospheric pressure and average cooling rate of 300° C./second. The tensile strength ($\sigma$f) and hardness of the sheets were measured by utilizing an Instron tensile test machine and a Vickers hardness meter. The impact strength and the bending strength thereof were evaluated in accordance with a Charpy impact test and a three-point bending test. As comparative examples, amorphous alloy sheets (comparative examples Nos. 1 and 2) were made by a regular non-pressure mold casting machine, and amorphous alloy sheets (comparative examples Nos. 4 to 6) having different minimum thickness were made by a pressure casting machine.

TABLE 1

| | Alloy Composition | Minimum Thickness (mm) | Hardness (Hv) | Tensile Strength (MPa) | Young's Modules (GPa) | Impact Strength (kJ/m$^2$) | Flexural Strength (GPa) | Bending Strength (MPa) |
|---|---|---|---|---|---|---|---|---|
| Example 1 | $Zr_{55}Al_{15}Ni_{10}Cu_{20}$ | 2 | 510 | 1870 | 92 | 162 | 116 | 3911 |
| Example 2 | $Zr_{55}Al_{15}Ni_{10}Cu_{20}$ | 4 | 520 | 1850 | 90 | 160 | 115 | 3894 |
| Example 3 | $Zr_{55}Ti_5Al_{10}Ni_{10}Cu_{20}$ | 2 | 515 | 1620 | 91 | 101 | 98 | 3050 |

TABLE 1-continued

| | Alloy Composition | Minimum Thickness (mm) | Hardness (Hv) | Tensile Strength (MPa) | Young's Modules (GPa) | Impact Strength ($kJ/m^2$) | Flexural Strength (GPa) | Bending Strength (MPa) |
|---|---|---|---|---|---|---|---|---|
| Example 4 | $Zr_{55}Ti_5Al_{10}Ni_{10}Cu_{20}$ | 5 | 510 | 1600 | 86 | 105 | 92 | 3010 |
| Example 5 | $Zr_{52.5}Ti_{3.5}Al_{15}Ni_{10}Cu_{20}$ | 2 | 520 | 1800 | 92 | 107 | 104 | 3300 |
| Comparative Example 1 | $Zr_{55}Al_{15}Ni_{10}Cu_{20}$ no pressure | 2 | 505 | 1870 | 91 | 72 | 80 | 1780 |
| Comparative Example 2 | $Ar_{55}Ti_5Al_{10}Ni_{10}Cu_{20}$ no pressure | 3 | 512 | 1630 | 89 | 75 | 81 | 1820 |
| Comparative Example 3 | $Zr_{55}Al_{15}Ni_{10}Cu_{30}$ | 0.5 | 510 | 1790 | 88 | 72 | 78 | 1760 |
| Comparative Example 4 | $Zr_{55}Al_{15}Ni_{10}Cu_{20}$ | 6 | 505 | 1205 | 96 | 74 | 102 | 1150 |
| Comparative Example 5 | $Zr_{55}Ti_5Al_{10}Ni_{10}Cu_{20}$ | 7 | 520 | 850 | 102 | 73 | 111 | 780 |
| Comparative Example 6 | $Zr_{52.5}Ti_{2.5}Al_{15}Ni_{10}Cu_{20}$ | 6 | 515 | 1300 | 98 | 75 | 108 | 1250 |

As apparent from Table 1, each of the amorphous alloys of embodiments Nos. 1 to 5 has the impact strength exceeding 100 $kj/m^2$, the bending strength exceeding 3000 MPa and the tensile strength of 1600 Mpa or more. Thus, by appropriately cooling it under pressure to maintain stress in the amorphous alloy sheet, these amorphous alloys have been greatly improved in strength against a bending load and an impact load without deteriorating the tensile strength inherent in an amorphous alloy.

However, as for the comparative examples Nos. 1 and 2 which were mold-cast under no pressure, although the compositions of these alloys were the same as those of the examples Nos. 1 and 3, respectively, and these alloys were complete amorphous alloys, the impact strength and the bending strength thereof were about 70 $kj/m^2$ and about 1700 Mpa which are not so improved.

As for the comparative examples Nos. 3 to 6, the pressure condition at the time of casting and the alloy composition were the same as those of the examples Nos. 1 and 2, but these comparative alloy sheets were intentionally controlled so as not to fall within the minimum thickness range of from 1 mm to 5 mm defined by the present invention. In the comparative example No. 3, the alloy was a complete amorphous alloy because it was cooled enough due to the small minimum thickness. However, the impact value and the bending strength were approximately the same as those of non-pressurized amorphous alloy(comparative examples Nos. 1 and 2). From the above, it is understood that no residual stress exerts a bad influence on an improvement of the impact value and the bending strength.

In the comparative examples Nos. 4 to 6, since their minimum thicknesses were large, compound crystals were deposited in part due to the insufficient cooling rate. Since these compound crystals function as a destruction start point, not only the impact value and the bending strength cannot be improved, but also the tensile strength inherent in an amorphous alloy deteriorates.

As will be apparent from the above, by applying a cooling rate difference to the surface and the interior of the materials under an appropriate pressure condition to manufacture an amorphous alloy sheet having inner residual stress, the strength against the impact load and the bending load can be given thereto without deteriorating its tensile strength inherent in an amorphous alloy.

INDUSTRIAL APPLICABILITY

As explained above, the present invention can provide a manufacturing method of an amorphous alloy sheet which is excellent in bending strength and impact strength and is reliable as practical structural materials.

What is claimed is:

1. A method of producing an amorphous alloy excellent in bending strength and impact strength, the method including the steps of:

eliminating casting defects by pressure-solidifying molten alloy under a pressure exceeding one atmospheric pressure; and solidifying the molten alloy by cooling a surface of the molten alloy at a cooling rate approximately 50% larger than a critical cooling rate, which is a lowest cooling rate at which the molten alloy forms an amorphous alloy, then cooling inside of the molten alloy at nearly around the critical cooling rate such that a compressive stress layer remains on the surface of the amorphous alloy and a tensile stress layer in the interior thereof.

2. The method of producing an amorphous alloy as recited in claim 1, wherein the amorphous alloy is an amorphous alloy sheet having a thickness of 1 mm or more.

* * * * *

UNITED STATES PATENT AND TRADEMARK OFFICE

CERTIFICATE OF CORRECTION

PATENT NO. : 6,306,228 B1
DATED : October 23, 2001
INVENTOR(S) : Akihisa Inoue et al.

It is certified that error appears in the above-identified patent and that said Letters Patent is hereby corrected as shown below:

Table 2,
This request is being made in order to correct Table 2, Comparative 2:
"$\mathbf{Ar_{55}Ti_5Al_{10}Ni_{10}Cu_{20}}$" should read as -- $\mathbf{Zr_{55}Ti_5Al_{10}Ni_{10}Cu_{20}}$ --.

Signed and Sealed this

Nineteenth Day of March, 2002

*Attest:*

*Attesting Officer*

JAMES E. ROGAN
*Director of the United States Patent and Trademark Office*